US005997065A

United States Patent [19]

Norris

[11] Patent Number: 5,997,065

[45] Date of Patent: Dec. 7, 1999

[54] PAIR OF IN-LINE SKATES CARRYING STRAP

[76] Inventor: Kirk Edward Norris, 51 W. Lemon Ave., Arcadia, Calif. 91007

[21] Appl. No.: 09/288,460

[22] Filed: Apr. 8, 1999

[51] Int. Cl.[6] ..... A45F 5/10

[52] U.S. Cl. ..... 294/159; 294/149; 294/165

[58] Field of Search ..... 294/31.2, 137, 294/149, 150, 153, 159, 160, 165, 170; 224/602, 609, 250

[56] References Cited

U.S. PATENT DOCUMENTS

| | | | |
|---|---|---|---|
| 3,225,984 | 12/1965 | Hyman | 294/150 |
| 3,709,545 | 1/1973 | Oltmanns | 294/159 |
| 4,331,357 | 5/1982 | Contreras | 294/145 |
| 4,488,748 | 12/1984 | Burkes | 294/170 |
| 4,791,702 | 12/1988 | McVey | 294/170 |
| 5,509,689 | 4/1996 | Lin | 280/811 |
| 5,513,787 | 5/1996 | Reed | 224/602 |
| 5,603,545 | 2/1997 | Benson et al. | 294/159 |
| 5,611,427 | 3/1997 | Bigham | 294/159 |
| 5,690,261 | 11/1997 | Moore | 224/578 |
| 5,709,425 | 1/1998 | Cordova | 294/162 |
| 5,785,223 | 7/1998 | Matsuhita | 294/170 |
| 5,788,305 | 8/1998 | Hung | 294/160 |
| 5,853,213 | 12/1998 | Simpson | 294/159 |

*Primary Examiner*—Dean J. Kramer
*Attorney, Agent, or Firm*—Goldstein & Canino

[57] ABSTRACT

A pair of in-line skates carrying strap including an elongated strap having opposed ends formed in equal loops whereby the opposed ends are secured together by a single band. The loops each are dimensioned for securedly wrapping around a single in-line skate. The elongated strap forms an upper carrying handle. The upper carrying handle is formed by an intermediate portion of the elongated strap.

2 Claims, 2 Drawing Sheets

PAIR OF IN-LINE SKATES CARRYING STRAP

BACKGROUND OF THE INVENTION

The present invention relates to a pair of in-line skates carrying strap and more particularly pertains to allowing for a person to carry a pair of in-line skates with a single hand.

In the past, it has been the conventional practice to carry in-line skates under the arm of the user similar to a person carrying a package or the shoestrings or the straps of the skates are tied together and the arrangement is placed around the skater's neck so that the hands are free. Alternately, the skater can carry one skate in each hand. Newer skates are not provided with strings, but instead are provided with buckles as closure means thereby eliminating one of the carrying options discussed above.

Therefore, it has been a long standing need to provide a novel means for carrying and transporting a pair of in-line skates from one place to another which is convenient not only from a size and weight viewpoint but from a securement consideration whereby the skates may be readily released from retention to the device or carrier.

The present invention seeks to provide a solution to these problems by utilizing a strap with a pair of loops for coupling with a pair of skates whereby the strap includes a padded handle for carrying the skates.

The use of carrying devices for skates is known in the prior art. More specifically, carrying devices for skates heretofore devised and utilized for the purpose of conveniently carrying skates are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,690,261 to Moore discloses a means for carrying skates comprised of a strap with two receptacles joined to form a loop. U.S. Pat. No. 4,331,357 to Contreras and U.S. Pat. No. 5,709,425 to Cordona each disclose means for carrying skates, Both of these devices utilize rigid devices. U.S. Pat. No. 5,509,689 to Lin discloses a means for gripping a roller skate comprised of a holding strap with buckles.

While these devices fulfill their respective, particular objective and requirements, the aforementioned patents do not describe a pair of in-line skates carrying strap for allowing for a person to carry a pair of in-line skates with a single hand.

In this respect, the pair of in-line skates carrying strap according to the present invention substantially departs from the conventional concepts and designs of the prior art, and in doing so provides an apparatus primarily developed for the purpose of allowing for a person to carry a pair of in-line skates with a single hand.

Therefore, it can be appreciated that there exists a continuing need for new and improved pair of in-line skates carrying strap which can be used for allowing for a person to carry a pair of in-line skates with a single hand. In this regard, the present invention substantially fulfills this need.

SUMMARY OF THE INVENTION

In the view of the foregoing disadvantages inherent in the known types of carrying devices for skates now present in the prior art, the present invention provides an improved pair of in-line skates carrying strap. As such, the general purpose of the present invention, which will be described subsequently in greater detail, is to provide a new and improved pair of in-line skates carrying strap and method which has all the advantages of the prior art and none of the disadvantages.

To attain this, the present invention essentially comprises an elongated strap having opposed ends formed in equal loops whereby the opposed ends are secured together by a single band. The opposed ends each have a male snap thereon for mating with corresponding female snaps on an interior of the single band. The loops each are dimensioned for securedly wrapping around a single in-line skate. The elongated strap forms an upper carrying handle. The upper carrying handle is formed by an intermediate portion of the elongated strap. The upper carrying handle has a padded member disposed therearound. The intermediate portion has a pouch formed thereon. The pouch is dimensioned for receiving an in-line skate adjustment tool.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pair of in-line skates carrying strap which has all the advantages of the prior art carrying devices for skates and none of the disadvantages.

It is another object of the present invention to provide a new and improved pair of in-line skates carrying strap which may be easily and efficiently manufactured and marketed.

It is a further object of the present invention to provide a new and improved pair of in-line skates carrying strap which is of durable and reliable construction.

An even further object of the present invention is to provide a new and improved pair of in-line skates carrying strap which is susceptible of a low cost of manufacture with regard to both materials and labor, and which accordingly is then susceptible of low prices of sale to the consuming public, thereby making such a pair of in-line skates carrying strap economically available to the buying public.

Even still another object of the present invention is to provide a new and improved pair of in-line skates carrying strap for allowing for a person to carry a pair of in-line skates with a single hand.

Lastly, it is an object of the present invention to provide a new and improved pair of in-line skates carrying strap including an elongated strap having opposed ends formed in equal loops whereby the opposed ends are secured together by a single band. The loops each are dimensioned for securedly wrapping around a single in-line skate. The elongated strap forms an upper carrying handle. The upper carrying handle is formed by an intermediate portion of the elongated strap.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
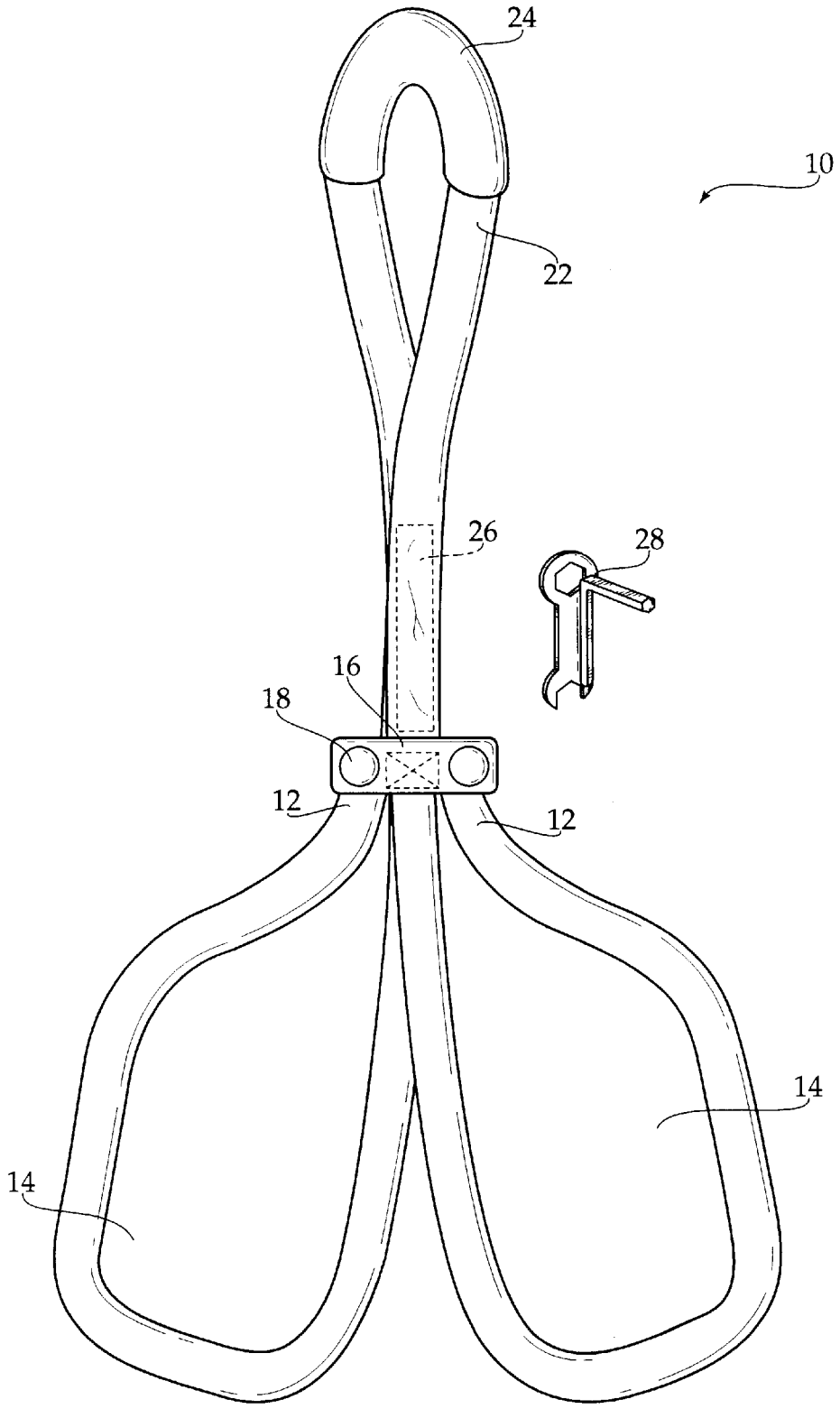
FIG. 1 is a perspective view of the preferred embodiment of the pair of in-line skates carrying strap constructed in accordance with the principles of the present invention.
Figure 2:
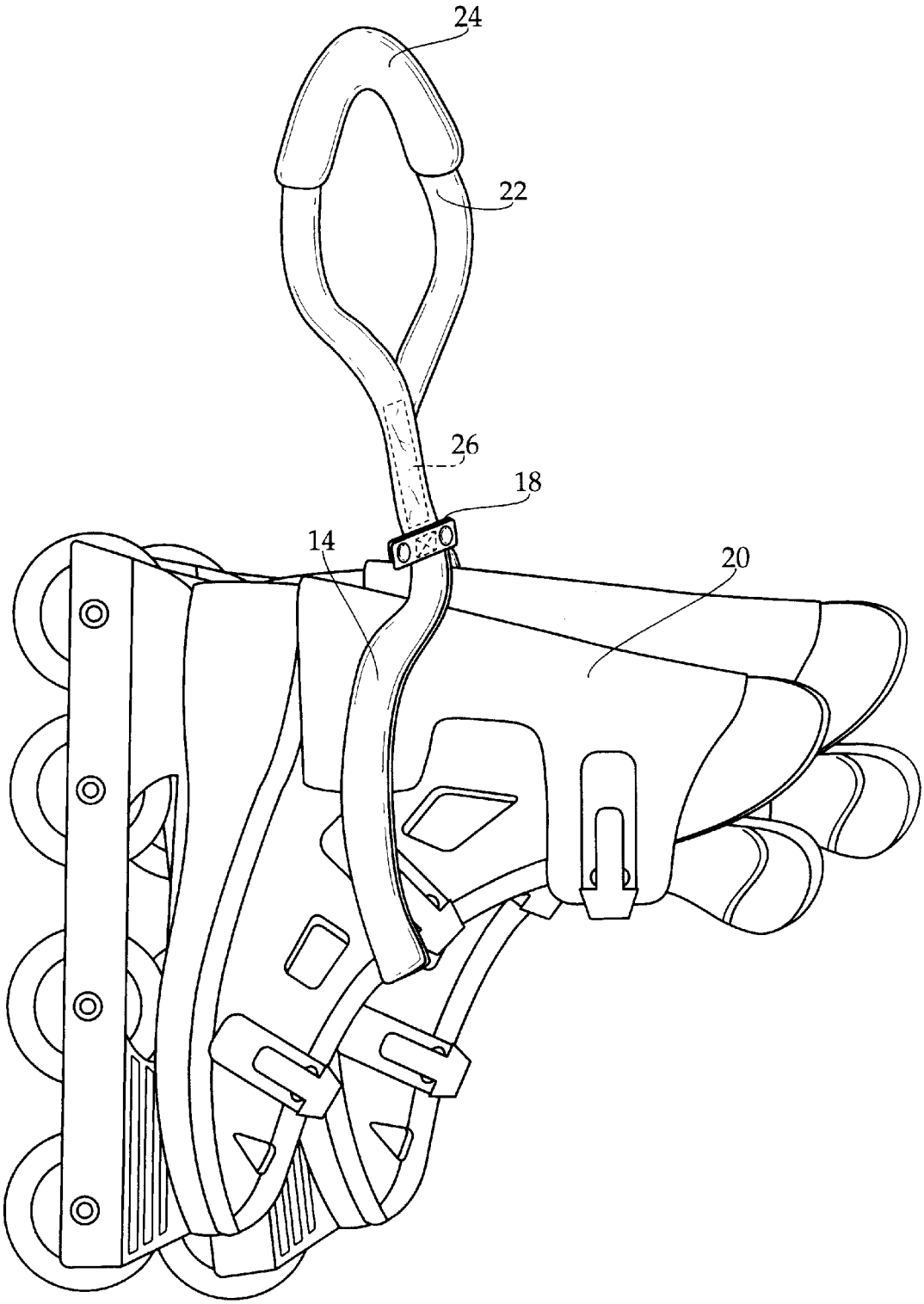
FIG. 2 is a side view of the present invention illustrated in use.

With reference now to the drawings, and in particular, to FIGS. 1 and 2 thereof, the preferred embodiment of the new and improved pair of in-line skates carrying strap embodying the principles and concepts of the present invention and generally designated by the reference number 10 will be described.

Specifically, it will be noted in the various Figures that the device relates to a pair of in-line skates carrying strap for allowing for a person to carry a pair of in-line skates with a single hand. In its broadest context, the device consists of an elongated strap and other minor components. Such components are individually configured and correlated with respect to each other so as to attain the desired objective.

The elongated strap has opposed ends 12 formed in equal loops 14 whereby the opposed ends 12 are secured together by a single band 16. The opposed ends 12 each have a male snap thereon for mating with corresponding female snaps 18 on an interior of the single band 16. The loops 14 each are dimensioned for securedly wrapping around a single in-line skate 20. The opposed ends 12 are simply detached from the single band 16 and wrapped around the in-line skate 20 and then snaps are then reattached to facilitate securement of the skate 20 to the elongated strap. The elongated strap forms an upper carrying handle 22. The upper carrying handle 22 is formed by an intermediate portion of the elongated strap. The upper carrying handle 22 has a padded member 24 disposed therearound. The intermediate portion has a pouch 26 formed thereon. The pouch 26 is dimensioned for receiving an in-line skate adjustment tool 28. Each of the loops 14 are equally spaced with respect to the carrying handle 22 thereby allowing for the pair of in-line skates 20 to be carried in balance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A pair of in-line skates carrying strap for allowing for a person to carry a pair of in-line skates with a single hand comprising, in combination:

an elongated strap having opposed ends formed in equal loops whereby the opposed ends are secured together by a single band, the opposed ends each having a male snap thereon for mating with corresponding female snaps on an interior of the single band, the loops each being dimensioned for securedly wrapping around a single in-line skate, the elongated strap forming an upper carrying handle, the upper carrying handle being formed by an intermediate portion of the elongated strap, the upper carrying handle having a padded member disposed therearound, the intermediate portion having a pouch formed thereon, the pouch being dimensioned for receiving an in-line skate adjustment tool.

2. A pair of in-line skates carrying strap for allowing for a person to carry a pair of in-line skates with a single hand comprising, in combination:

an elongated strap having opposed ends formed in equal loops whereby the opposed ends are secured together by a single band and have a male snaps thereon for mating with corresponding female snaps on an interior of said single band, the loops each being dimensioned for securedly wrapping around a single in-line skate, the elongated strap forming an upper carrying handle, the upper carrying handle being formed by an intermediate portion of the elongated strap.

* * * * *